US007954501B2

(12) United States Patent
Sprecher

(10) Patent No.: US 7,954,501 B2
(45) Date of Patent: Jun. 7, 2011

(54) PRESSURE CLEANER ACCESSORY

(75) Inventor: Kenneth A. Sprecher, Lacey, WA (US)

(73) Assignee: Easywasher Corporation, Tacoma, WA (US)

( * ) Notice: Subject to any disclaimer, the term of this patent is extended or adjusted under 35 U.S.C. 154(b) by 446 days.

(21) Appl. No.: 11/683,398

(22) Filed: Mar. 7, 2007

(65) Prior Publication Data

US 2008/0000501 A1 Jan. 3, 2008

Related U.S. Application Data

(60) Provisional application No. 60/780,342, filed on Mar. 8, 2006.

(51) Int. Cl.

| | |
|---|---|
| ***B08B 3/02*** | (2006.01) |
| ***B08B 3/04*** | (2006.01) |
| ***B05B 3/02*** | (2006.01) |
| ***B05B 3/18*** | (2006.01) |
| ***B05B 9/03*** | (2006.01) |

(52) U.S. Cl. ..... 134/198; 134/172; 239/754; 239/552

(58) Field of Classification Search ..... 134/172, 134/182, 198; 239/722, 754, 225.1, 552, 239/565; 137/561 A
See application file for complete search history.

(56) References Cited

U.S. PATENT DOCUMENTS

| | | | | |
|---|---|---|---|---|
| 2,243,597 | A | 5/1941 | Elliott | 299/46 |
| 2,683,327 | A * | 7/1954 | Hagens | 239/654 |
| 3,931,931 | A | 1/1976 | Otis et al. | 239/287 |
| 4,376,513 | A | 3/1983 | Hagar | 239/231 |
| 4,463,904 | A | 8/1984 | Bray, Jr. | 239/284 |
| 4,736,888 | A * | 4/1988 | Fasnacht | 239/161 |
| 5,230,471 | A | 7/1993 | Berfield | 239/124 |
| 2005/0023382 | A1 * | 2/2005 | Fiedler et al. | 239/566 |
| 2006/0222438 | A1 * | 10/2006 | Alexander et al. | 401/48 |

* cited by examiner

*Primary Examiner* — Michael Kornakov
*Assistant Examiner* — Natasha Campbell
(74) *Attorney, Agent, or Firm* — Merchant & Gould

(57) ABSTRACT

A pressure cleaner provides a splitter for dividing a fluid stream to a plurality of nozzles without a substantial loss in pressure. A frame is provided to help maintain angle and distances of the spray nozzles relative to each other and to a surface to be cleaned.

20 Claims, 4 Drawing Sheets

PRESSURE CLEANER ACCESSORY

RELATED APPLICATION

This utility patent application claims the benefit under 35 United States Code §119(e) of U.S. Provisional Patent Application No. 60/780,342 filed on Mar. 8, 2006, which is hereby incorporated by reference in its entirety.

BACKGROUND

Conventional pressure cleaners such as a pressure washer are used to deliver a cleaning fluid (including solutions that use various combinations of solvents, water, including steam, detergents, and the like) under pressure. The pressure washer is often connected via a hose to a source of a cleaning fluid, which is usually provided at a relatively low pressure. The pressure washer typically comprises a motor that can be used to increase the pressure (and/or temperature) of the fluid. The pressure washer often provides the fluid under pressure to a fluid receiving end of a discharge hose. The discharging end of the discharge hose can be coupled to a hand-held wand. The hand-wand usually comprises a handle having a trigger valve that is arranged to control the flow of the pressurized fluid received from the discharge hose. The fluid discharge end of the hand-wand often comprises a single spray nozzle.

In operation, an operator of a pressure cleaner typically holds the handle and trigger with one hand and a central portion of the wand with the other hand. The user can clean a flat surface, for example, by pulling the trigger of the trigger valve and by making sweeping motions such that the pressurized fluid is delivered through the spray nozzles to the surface to be cleaned. However, the pressure wand is cumbersome to operate by hand because of the weight of the wand and fluid, and the forces generated by the pressurized fluid escaping the nozzle. Also, the effective working area of the spray pattern of the escaping pressurized fluid is relatively narrow and often requires many sweeps of the wand to clean the flat surface.

Some have tried to solve this problem by attaching the discharge hose to a "water broom." The water broom, similar in general shape to a push broom, receives the fluid under pressure from the discharge hose and channels the fluid through a manifold to a plurality of nozzles that are attached to the manifold. The plurality of nozzles can increase the effective working area of the spray pattern. However, the manifold often forces the fluid to be channeled through and around 90 degree turns, which causes turbulence, and substantially decreases the effective pressure of the pressurized fluid escaping the nozzles. The substantially decreased pressure results in less-effective cleaning ability of the device and often requires substantially more stationing time of the nozzles of the surface to be cleaned.

SUMMARY

In general terms, this patent relates to a pressure cleaner attachment accessory for maximizing the pressure of escaping pressurized fluid for cleaning a surface.

A pressure cleaner provides a splitter for dividing a fluid stream to a plurality of nozzles without a substantial loss in pressure and/or kinetic energy of the fluid stream. A frame is provided to help maintain angle and distances of the spray nozzles relative to each other and to a surface to be cleaned.

DETAILED DESCRIPTION

Figure 1:
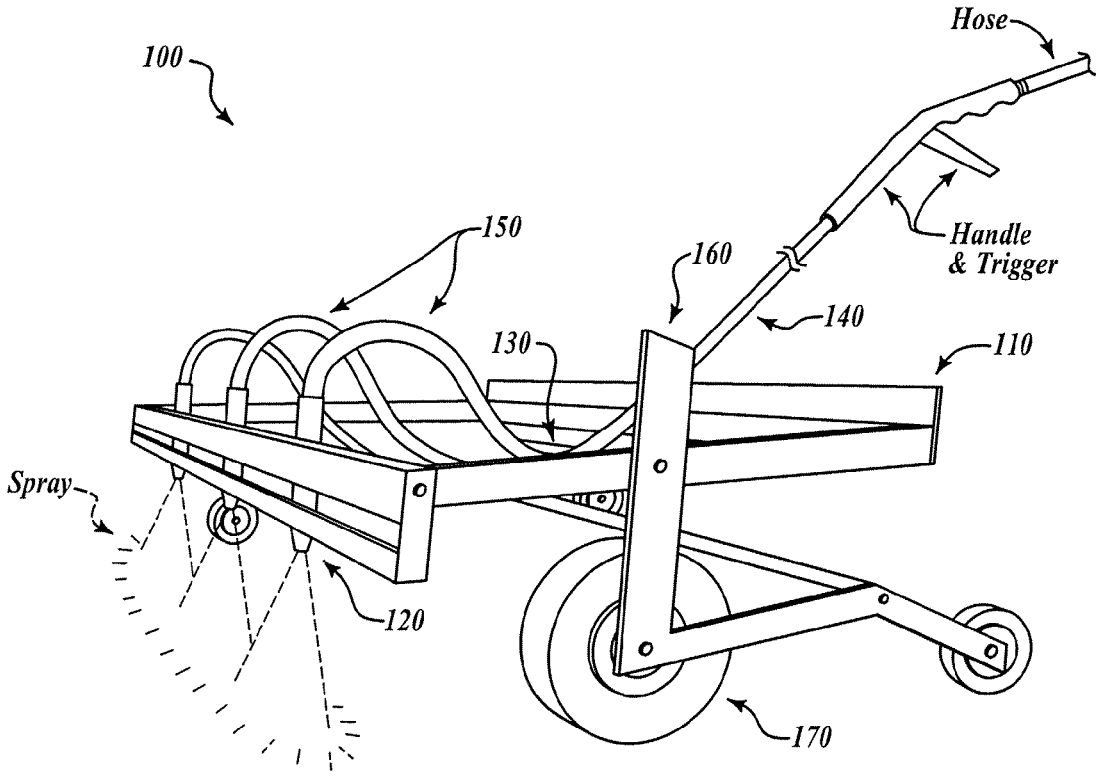
FIG. 1 illustrates a pressure cleaner attachment accessory.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Some pressure washers have used a plurality of nozzles to more widely distribute a cleaning spray. A "water broom," similar in general shape to a push broom, receives the fluid under pressure from the discharge hose and channels the fluid through a manifold to a plurality of nozzles that are attached to the manifold. The plurality of nozzles can increase the effective working area of the spray pattern. However, the manifold often forces the fluid to be channeled through and around 90 degree turns. The channeling, which contains abrupt turns, causes backflow turbulence, which minimizes kinetic energy of the channeled fluid. Thus the channeling substantially decreases the effective pressure and/or energy of the pressurized fluid escaping the nozzles. The substantially decreased pressure results in less-effective cleaning ability of the device and often requires substantially more stationing time of the nozzles of the surface to be cleaned.

FIG. 1 illustrates a pressure cleaner attachment accessory. Washer 100 comprises an upper frame 110 having a fluid receiving portion and a fluid discharging portion; a plurality of spray nozzles 120 coupled to the fluid discharge portion of the upper frame, the spray nozzles 120 comprising a fluid receiving end and a fluid discharging end; a fluid stream splitter 130 coupled to the fluid receiving portion of the upper frame, the fluid stream splitter 130 having a wand 140 receiving end and a plurality of fluid discharge ends; a fluid coupling 150 providing fluid communication between the fluid discharge ends of the fluid stream splitter and the fluid receiving ends of the plurality of spray nozzles; and a lower frame 160 coupled to the upper frame 110, the lower frame having first and second wheels 170 coupled to the lower frame.

In various embodiments, the fluid discharge portion of the upper frame includes a spray nozzle mounting bracket for mounting the plurality of spray nozzles thereto. Additionally, the spray nozzle mounting bracket can be rotatably adjustable. The washer can also comprise a wand support coupled to the fluid receiving portion of the (upper and/or lower) frame. Moreover, the adjustable brace can comprise a first end portion and a second end portion, with the first end portion being adjustably coupled to the fluid receiving portion of the upper and/or lower frame. The lower frame can be adjustably secured to the upper frame and the lower frame can be adjustably secured to the upper frame. The washer can also comprise a swivel wheel (e.g. castered wheel) coupled to the lower frame (for example, two forward wheels can be fixed and one or more rearward wheels can be castered and/or steerable).

In operation, the washer 100 typically rolls using the wheels on the frame. The frame normally has a forward portion (which is typically towards the nozzle-end) and a rearward portion (which is typically near a fluid receiving end). The frame normally works to keep the nozzle angle (relative to the surface being sprayed) constant. If the nozzle angle varies too much, the washer can either not clean well enough (if heeled back too far) or if tipped forward too much "dig in" to the surface being cleaned (which can leave unsightly marks).

Figure 2A:
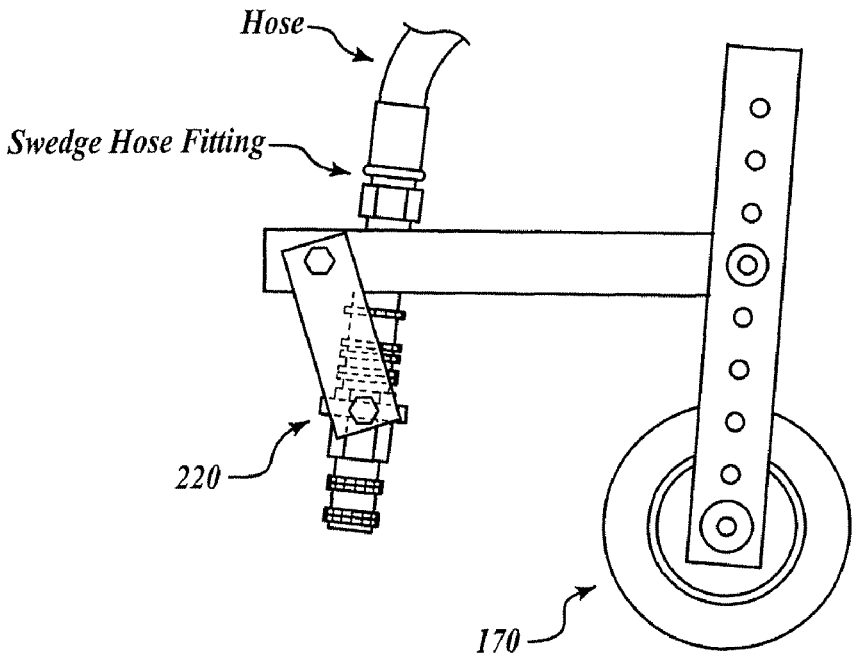
FIG. 2*a* illustrates spray nozzle angle and height adjustment.
Figure 2B:
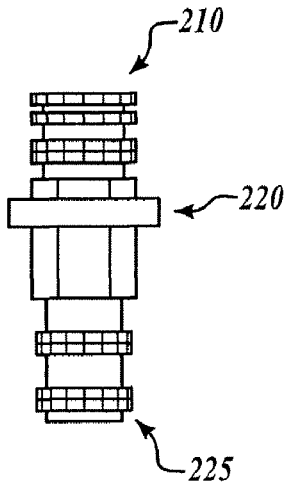
FIG. 2*b* illustrates a mount for accommodating quick-release fittings for spray nozzles and fluid couplings.

A front bar on the forward portion of the frame holding the nozzles can be adjusted to change the height and/or angle of the nozzles (by rotating, for example) and of course also is adjustable up and down (by translating along an upward/downward axis, as shown in FIG. 2*a*). Also, the front bar of the frame can be rotated along an axis defined by securing means to adjust the angle of the nozzles. Each nozzle can be mounted so as to have individual height and angle (left-right, forwards and backwards) adjustments. The nozzles can use quick-release fittings 210 and 225 for mounting the nozzle and attaching a hose to the nozzle mounting 225 as shown in FIG. 2*b*).

Figure 2C:
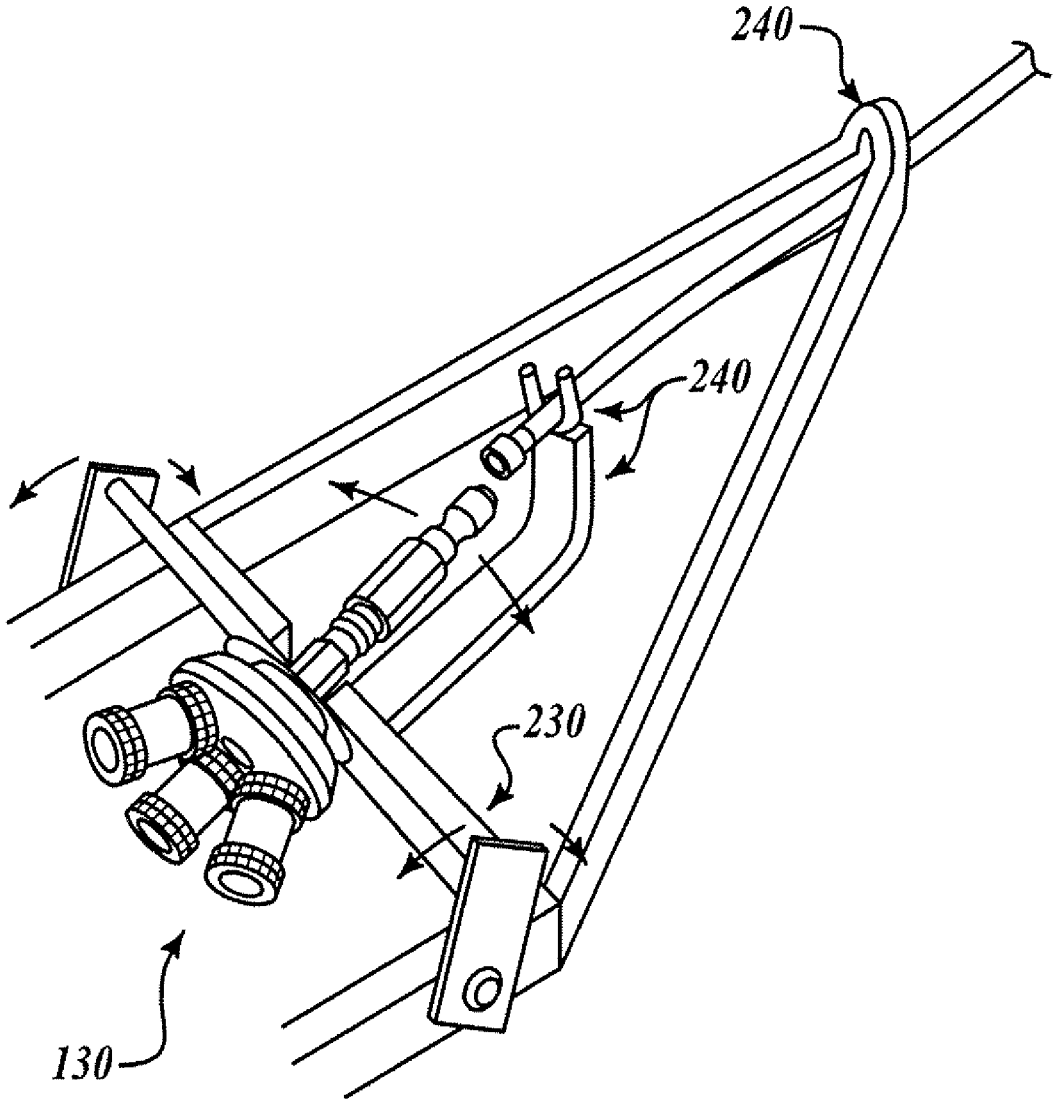
FIG. 2*c* illustrates a splitter used with a pressure cleaner attachment accessory and an adjustable bar for securing the accessory.

The rear bar 230 (as shown in FIG. 2*c*) of the rear portion of the frame can be used to supply tension on a pressure washer wand or pole. The rear bar can be adjusted (rotatably and/or longitudinally) to secure the wand that has been inserted in braces 240, for example, by pressing the wand against the braces. A screw knob, for example, can be used to secure the rear bar 230.

The wand can be used to steer the washer/wand unit. The frame of the washer can have a locking attachment so that the wand can be removeably affixed. The bar height can be adjusted to position the nozzles at a desired height above the surface to be cleaned so as to provide maximum cleaning ability. The water spray can be adjusted to provide a white mist. The nozzles are typically adjusted to provide some overlap in spray coverage, which can minimize streaking that might otherwise occur between nozzles.

FIG. 2*c* is an illustration of a three-way splitter for diverting a fluid stream into different channels. (Differing numbers of diverter channels can be used such as two-, four-, and five-way splitters.) The splitter typically divides the water equally into different channels to minimize "backflow," which is turbulence that minimizes fluid pressure and kinetic energy. The splitter minimizes backflow by avoiding abrupt angles in the fluid channels. Typically the splitter is arranged in a pyramidal structure where the fluid stream is channeled down each edge of the pyramid. Normally, the less the diversion angle of the water is (such as less than 90 degrees), the less the backflow turbulence is.

In various embodiments the frame can be used with a variety of cleaning devices such as pressure washers and steam cleaners. Normally the wand of the cleaning device can be easily detached and re-secured using the rear bar adjustment screw, for example.

Figure 3:
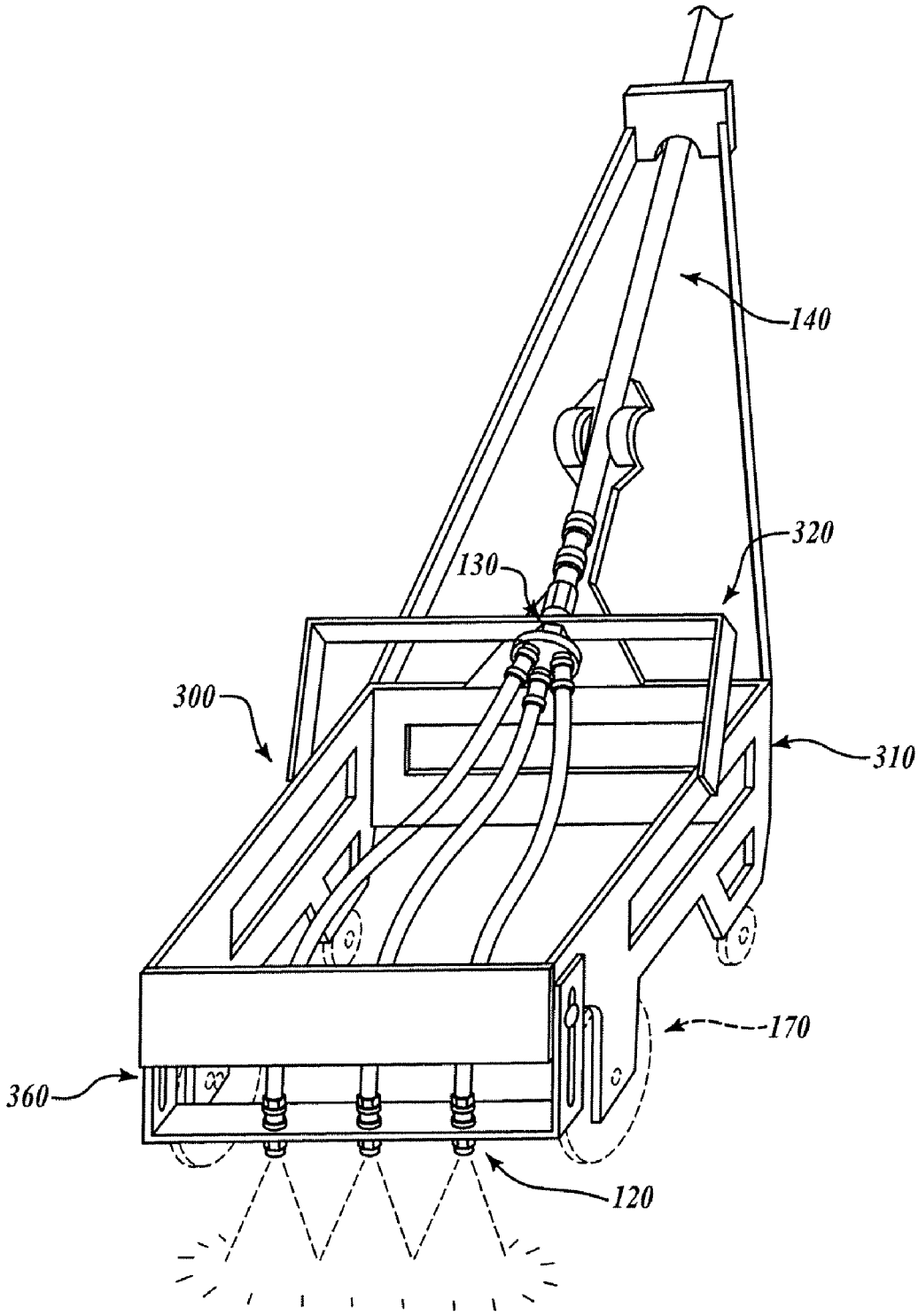
FIG. 3 is an illustration of an alternate embodiment of a pressure washer attachment accessory.

FIG. 3 is an illustration of an alternate embodiment of a pressure washer attachment accessory. Washer 300 comprises a first frame 310 that in turn comprises a bracket 320 for captivating splitter 130. Second frame 360 captives a plurality of spray nozzles. The height and angle of the plurality of spray nozzles can be adjusted by using a channel through which a securing means can allow the angle and relative position of the second frame to the first frame to be adjusted and then secured when the desired adjustment is made. The adjustment can be made to develop a spray pattern with sufficient overlap (to avoid areas that are not cleaned), to avoid excessive overlap (to increase efficiency), and to position the nozzle an optimum height for cleaning a surface (to remove undesired surface material without "digging in," for example).

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A pressure cleaning apparatus, the apparatus comprising:

a first frame having a fluid receiving portion for receiving a fluid and a fluid discharging portion for discharging the fluid;

a plurality of spray nozzles coupled to the fluid discharge portion of the first frame, the spray nozzles comprising a fluid receiving end and a fluid discharging end;

a fluid stream splitter coupled to the fluid receiving portion of the first frame, the fluid stream splitter having a wand receiving end that receives a wand of a pressure washer and a plurality of fluid discharge ends; wherein the fluid stream splitter is arranged in a pyramidal structure that splits the received fluid into a different channel for each of the plurality of fluid discharge ends;

a fluid coupling providing fluid communication between the fluid discharge ends of the fluid stream splitter and the fluid receiving ends of the plurality of spray nozzles; and a second frame coupled to the first frame, the second frame captivating the plurality of spray nozzles.

2. The apparatus of claim 1 wherein the second frame includes a longitudinal channel in which the second frame can be translated in position with respect to the first frame.

3. The apparatus of claim 2 wherein the second frame is also rotatably adjustable.

4. The apparatus of claim 1 further comprising a wand support coupled to the fluid receiving portion of the first frame.

5. The apparatus of claim 1 further comprising an adjustable brace having a first end portion and a second end portion, the first end portion being adjustably coupled to the fluid receiving portion of the first frame.

6. The apparatus of claim 5 wherein the adjustable brace is configured to simultaneously adjust the spraying angle of the plurality of spray nozzles.

7. The apparatus of claim 1 wherein the second frame is adjustably secured to the first frame.

8. The apparatus of claim 7 wherein adjustment of the securing mechanism is adapted to adjust a height of the first frame.

9. The apparatus of claim 7 wherein adjustment of the securing mechanism is adapted to adjust a height of the second frame.

10. The apparatus of claim 1 further comprising a swivel wheel coupled to the first and/or second frame.

11. The apparatus of claim 1 further comprising a wand that is coupled to the fluid stream splitter having a wand receiving end.

12. The apparatus of claim 11 wherein the second frame is adapted to captivate the wand.

13. A method comprising:

providing a first frame having a fluid receiving portion for receiving a fluid and a fluid discharging portion for discharging the fluid;

coupling a plurality of spray nozzles to the fluid discharge portion of the first frame, the spray nozzles comprising a fluid receiving end and a fluid discharging end;

coupling a fluid stream splitter to the fluid receiving portion of the first frame, the fluid stream splitter having a wand receiving end that receives a pressure wand and a plurality of fluid discharge ends; wherein the fluid stream splitter splits the received fluid into a different channel for each of the plurality of fluid discharge ends;

providing fluid communication between the fluid discharge ends of the fluid stream splitter and each of the fluid receiving ends of the plurality of spray nozzles;

coupling a second frame to the first frame, the second frame having first and second wheels coupled to the second frame.

14. The method of claim 13 wherein the fluid stream splitter is adapted to channel a fluid stream into a plurality of channels without using an angle of around 90 degrees.

15. The method of claim 13 further comprising coupling the nozzles to an adjustable nozzle mounting bar.

16. The method of claim 15 further comprising adjusting a spray angle of the plurality of spray nozzles by adjusting the nozzle mounting bar.

17. The method of claim 13 further comprising adjusting the height of the plurality of spray nozzles by adjusting the height at which the provided first frame is coupled to the second frame.

18. The method of claim 17 further comprising adjusting the angle of the plurality of spray nozzles by adjusting the angle at which the first frame is coupled to the second frame.

19. The method of claim 15 further comprising adjusting a spray angle of the plurality of spray nozzles by adjusting the nozzle mounting bar, comprising adjusting the height of the plurality of spray nozzles by adjusting the height at which the provided first frame is coupled to the second frame, and adjusting the angle of the plurality of spray nozzles by adjusting the angle at which the first frame is coupled to the second frame.

20. A pressure cleaner comprising:

means for providing an first frame having a fluid receiving portion for receiving a fluid and a fluid discharging portion for discharging the fluid;

means for coupling a plurality of spray nozzles to the fluid discharge portion of the first frame, the spray nozzles comprising a fluid receiving end and a fluid discharging end;

means for coupling a fluid stream splitter to the fluid receiving portion of the first frame, the fluid stream splitter having a wand receiving end that receives a wand of a pressure washer and a plurality of fluid discharge ends; wherein the fluid stream splitter is arranged in a pyramidal structure;

means for providing fluid communication between the fluid discharge ends of the fluid stream splitter and the fluid receiving ends of the plurality of spray nozzles; and means for coupling a second frame to the first frame, the second frame having first and second wheels coupled to the second frame.

* * * * *